US006020302A

United States Patent [19]

Leurentop et al.

[11] Patent Number: 6,020,302

[45] Date of Patent: Feb. 1, 2000

[54] COLOR CARE COMPOSITIONS

[75] Inventors: Linda Josefina Anna Leurentop, Zoersel, Belgium; Janet Sue Littig, Fairfield, Ohio; Axel Masschelein, Brussels, Belgium

[73] Assignee: The Procter & Gamble Company, Cincinnati, Ohio

[21] Appl. No.: 09/269,097

[22] PCT Filed: Sep. 18, 1997

[86] PCT No.: PCT/US97/16546

§ 371 Date: Mar. 19, 1999

§ 102(e) Date: Mar. 19, 1999

[87] PCT Pub. No.: WO98/12296

PCT Pub. Date: Mar. 26, 1998

[51] Int. Cl.[7] ..... D06M 13/224

[52] U.S. Cl. ..... 510/475; 510/476; 510/517

[58] Field of Search ..... 510/475, 476, 510/517, 528

[56] References Cited

U.S. PATENT DOCUMENTS

| | | | |
|---|---|---|---|
| 4,622,378 | 11/1986 | Gosselink | 528/66 |
| 4,711,730 | 12/1987 | Gosselink et al. | 252/8.75 |
| 5,458,809 | 10/1995 | Fredj et al. | 252/542 |
| 5,721,202 | 2/1998 | Waite et al. | 510/102 |

FOREIGN PATENT DOCUMENTS

| | | |
|---|---|---|
| 043622 A1 | 1/1982 | European Pat. Off. . |
| 269169 A2 | 6/1988 | European Pat. Off. . |
| 462806 A2 | 12/1991 | European Pat. Off. . |
| WO 96/27649 | 9/1996 | WIPO . |

*Primary Examiner*—John Hardee
*Attorney, Agent, or Firm*—R. S. Echler, Sr.; K. W. Zerby; J. C. Rasser

[57] ABSTRACT

The present invention is a composition comprising a dye fixing agent and a specific aminon-functional polymer, said composition providing an improved color care on fabric upon laundry treatments.

13 Claims, No Drawings

COLOR CARE COMPOSITIONS

FIELD OF THE INVENTION

The present invention relates to compositions which provide care to the colors of fabrics in laundry treatment.

BACKGROUND OF THE INVENTION

The appearance of colored fabrics, e.g., clothing, bedding, household fabrics like table linens is one of the areas of concern to consumers. Indeed, upon typical consumer's uses of the fabrics such as wearing, washing, rinsing and/or tumble-drying of fabrics, a loss in the fabric appearance, which is at least partly due to loss of color fidelity and color definition, is observed. Such a problem of color loss is even more acute in laundry treatment after multiwash cycles.

It is therefore an object of the invention to provide a composition which provides improved color appearance of the laundered fabrics, especially after multiwash cycles.

The Applicant has now surprisingly found that the combination of a dye fixing agent and an amino-functional polymer overcomes the problem.

SUMMARY OF THE INVENTION

The present invention is a composition comprising a dye fixing agent and an amino-functional polymer comprising a polyamine backbone corresponding to the formula:

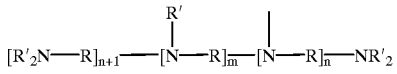

having a polyamine formula $V_{(n+1)}W_mY_nZ$ or a polyamine backbone corresponding to the formula:

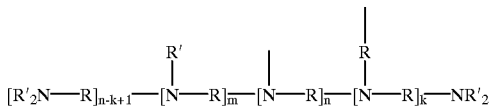

having a polyamine formula $V_{(n-k+1)}W_mY_nY'_kZ$, wherein k is less than or equal to n, said polyamine backbone has a molecular weight greater than 200 daltons, wherein i) V units are terminal units having the formula:

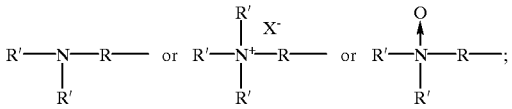

ii) W units are backbone units having the formula:

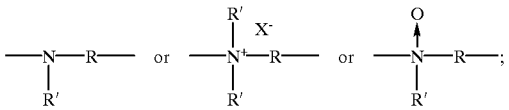

iii) Y units are branching units having the formula:

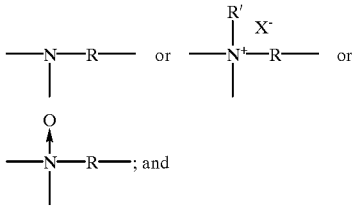

iv) Y' units are branch point for a backbone or branch ring having the formula:

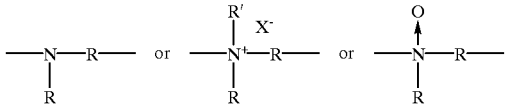

v) Z units are terminal units having the formula:

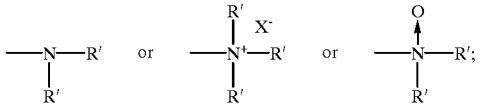

wherein backbone linking R units are selected from the group consisting of $C_2$–$C_{12}$ alkylene, $C_4$–$C_{12}$ alkenylene, $C_3$–$C_{12}$ hydroxyalkylene, $C_4$–$C_{12}$ dihydroxyalkylene, $C_8$–$C_{12}$ dialkylarylene, —$(R^1O)_xR^1$, —$(R^1O)_xR^5(OR^1)_x$—, —$(CH_2CH(OR^2)CH_2O)_z(R^1O)_yR^1(OCH_2CH(OR^2)CH_2)_w$—, —$C(O)(R^4)C(O)$—, —$CH_2CH(OR^2)CH_2$—, and mixtures thereof; wherein $R^1$ is selected from the group consisting of $C_2$–$C_6$ alkylene and mixtures thereof; $R^2$ is selected from the group consisting of hydrogen, —$(R^1O)_xB$, and mixtures thereof; $R^4$ is selected from the group consisting of $C_1$–$C_{12}$ alkylene, $C_4$–$C_{12}$ alkenylene, $C_8$–$C_{12}$ arylalkylene, $C_6$–$C_{10}$ arylene, and mixtures thereof; $R^5$ is selected from the group consisting of $C_1$–$C_{12}$ alkylene, $C_3$–$C_{12}$ hydroxyalkylene, $C_4$–$C_{12}$ dihydroxy-alkylene, $C_8$–$C_{12}$ dialkylaryiene, —C(O)—, —C(O)NHR$^6$NHC(O)—, —$R^1(OR^1)$—, —$C(O)(R^4)_rC(O)$—, —$CH_2CH(OH)CH_2$—, —$CH_2CH(OH)CH_2O(R^1O)_yR^1OCH_2CH(OH)CH_2$—, and mixtures thereof; $R^6$ is selected from the group consisting of $C_2$–$C_{12}$ alkylene or $C_6$–$C_{12}$ arylene; R' units are selected from the group consisting of hydrogen, $C_1$–$C_{22}$ alkyl, $C_3$–$C_{22}$ alkenyl, $C_7$–$C_{22}$ arylalkyl, $C_2$–$C_{22}$ hydroxyalkyl, —$(CH_2)_pCO_2M$, —$(CH_2)_qSO_3M$, —$CH(CH_2CO_2M)CO_2M$, —$(CH_2)_pPO_3M$, —$(R^1O)_xB$, —$C(O)R^3$, and mixtures thereof; oxide; B is selected from the group consisting of hydrogen, $C_1$–$C_6$ alkyl, —$(CH_2)_qSO_3M$, —$(CH_2)_pCO_2M$, —$(CH_2)_q(CHSO_3M)CH_2SO_3M$, —$(CH_2)_q$—$(CHSO_2M)CH_2SO_3M$, —$(CH_2)_pPO_3M$, —$PO_3M$, and mixtures thereof; $R^3$ is selected from the group consisting of $C_1$–$C_{18}$ alkyl, $C_7$–$C_{12}$ arylalkyl, $C_7$–$C_{12}$ alkyl substituted aryl, $C_6$–$C_{12}$ aryl, and mixtures thereof; M is hydrogen or a water-soluble cation in sufficient amount to satisfy charge balance; X is a water-soluble anion; m has the value from 2 to 700; n has the value from 0 to 350; p has the value from 1 to 6, q has the value from 0 to 6; r has the value of 0 or 1; w has the value 0 or 1; x has the value from 1 to 100; y has the value from 0 to 100; z has the value 0 or 1.

In a preferred embodiment of the invention, the composition further comprises a fabric softener component.

In another aspect of the invention, there is provided a method for providing color care to fabrics upon domestic laundering treatments which comprise the step of contacting the fabrics with an aqueous medium comprising said composition.

In a further aspect, there is provided a method for providing color care on treated fabrics upon domestic treatment which comprises the step of contacting the fabrics with said composition, wherein said composition is applied on a substrate, preferably a dryer-sheet.

DETAILED DESCRIPTION OF THE INVENTION

Dye fixing agent

An essential component of the invention is a dye fixing agent. Dye fixing agents, or "fixatives", are well-known, commercially available materials which are designed to improve the appearance of dyed fabrics by minimizing the loss of dye from fabrics due to washing. Not included within this definition are components which are fabric softeners or those described hereinafter as amino-functional polymers.

Many dye fixing agents are cationic, and are based on various quaternized or otherwise cationically charged organic nitrogen compounds. Cationic fixatives are available under various trade names from several suppliers. Representative examples include: CROSCOLOR PMF (July 1981, Code No. 7894) and CROSCOLOR NOFF (January 1988, Code No. 8544) from Crosfield; INDOSOL E-50 (Feb. 27, 1984, Ref. No. 6008.35.84; polyethyleneamine-based) from Sandoz; SANDOFIX TPS, which is also available from Sandoz and is a preferred polycationic fixative for use herein and SANDOFIX SWE (cationic resinous compound), REWIN SRF, REWIN SRF-O and REWIN DWR from CHT-Beitlich GMBH, Tinofix® ECO, Tinofix®FRD and Solfin® available from Ciba-Geigy.

Other cationic dye fixing agents are described in "After-treatments for improving the fastness of dyes on textile fibres" by Christopher C. Cook (REV. PROG. COLORATION Vol. 12, 1982). Dye fixing agents suitable for use in the present invention are ammonium compounds such as fatty acid-diamine condensates e.g. the hydrochloride, acetate, metosulphate and benzyl hydrochloride of oleyldiethyl aminoethylamide, oleylmethyldiethylenediaminemethosulphate, monostearylethylene diaminotrimethylammonium methosulphate and oxidized products of tertiary amines; derivatives of polymeric alkyldiamines, polyaminecyanuric chloride condensates and aminated glycerol dichlorohydrins.

A typical amount of the dye fixing agent to be employed in the composition of the invention is preferably up to 90% by weight, preferably up to 50% by weight, more preferably from 0.001% to 10% by weight, most preferably from 0.5% to 5% active by weight of the composition.

Amino-functional polymer

The other essential component of the invention is an amino-functional polymer comprising a polyamine backbone. The amino-functional polymers of the present invention are water-soluble or dispersible, polyamines. Typically, the amino-functional polymers for use herein have a molecular weight between 200 and $10^6$, preferably between 600 and 20,000, most preferably between 1000 and 10,000. These polyamines comprise backbones that can be either linear or cyclic. The polyamine backbones can also comprise polyamine branching chains to a greater or lesser degree. Preferably, the polyamine backbones described herein are modified in such a manner that at least each nitrogen of the polyamine chain is thereafter described in terms of a unit that is substituted, quaternized, oxidized, or combinations thereof.

For the purposes of the present invention the term "modification" as it relates to the chemical structure of the polyamines is defined as replacing a backbone -NH hydrogen atom by an R' unit (substitution), quaternizing a backbone nitrogen (quaternized) or oxidizing a backbone nitrogen to the N-oxide (oxidized). The terms "modification" and "substitution" are used interchangably when referring to the process of replacing a hydrogen atom attached to a backbone nitrogen with an R' unit. Quaternization or oxidation may take place in some circumstances without substitution, but substitution is preferably accompanied by oxidation or quaternization of at least one backbone nitrogen.

The linear or non-cyclic polyamine backbones that comprise the amino-functional polymer have the general formula:

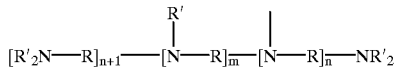

The cyclic polyamine backbones that comprise the amino-functional polymer have the general formula:

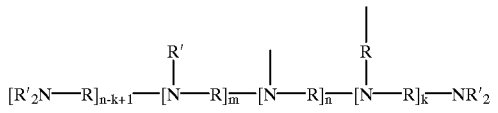

The above backbones prior to optional but preferred subsequent modification, comprise primary, secondary and tertiary amine nitrogens connected by R "linking" units.

For the purpose of the present invention, primary amine nitrogens comprising the backbone or branching chain once modified are defined as V or Z "terminal" units. For example, when a primary amine moiety, located at the end of the main polyamine backbone or branching chain having the structure $H_2N—R]—$ is modified according to the present invention, it is thereafter defined as a V "terminal" unit, or simply a V unit. However, for the purposes of the present invention, some or all of the primary amine moieties can remain unmodified subject to the restrictions further described herein below. These unmodified primary amine moieties by virtue of their position in the backbone chain remain "terminal" units. Likewise, when a primary amine moiety, located at the end of the main polyamine backbone having the structure $—NH_2$ is modified according to the present invention, it is thereafter defined as a Z "terminal" unit, or simply a Z unit. This unit can remain unmodified subject to the restrictions further described hereinbelow.

In a similar manner, secondary amine nitrogens comprising the backbone or branching chain once modified are defined as W "backbone" units. For example, when a secondary amine moiety, the major constituent of the backbones and branching chains of the present invention, having the structure

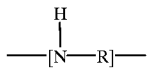

is modified according to the present invention, it is thereafter defined as a W "backbone" unit, or simply a W unit. However, for the purposes of the present invention, some or all of the secondary amine moieties can remain unmodified. These unmodified secondary amine moieties by virtue of their position in the backbone chain remain "backbone" units.

In a further similar manner, tertiary amine nitrogens comprising the backbone or branching chain once modified are further referred to as Y "branching" units. For example, when a tertiary amine moiety, which is a chain branch point of either the polyamine backbone or other branching chains or rings, having the structure

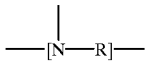

is modified according to the present invention, it is thereafter defined as a Y. "branching" unit, or simply a Y unit. However, for the purposes of the present invention, some or all of the tertiary amine moieties can remain unmodified. These unmodified tertiary amine moieties by virtue of their position in the backbone chain remain "branching" units. The R units associated with the V, W and Y unit nitrogens which serve to connect the polyamine nitrogens, are described hereinbelow.

The final modified structure of the polyamines of the present invention can therefore be represented by the general formula $$V_{(n+1)}W_mY_nZ$$

for linear amino-functional polymer and by the general formula $$V_{(n-k+1)}W_mY_nY'_kZ$$

for cyclic amino-functional polymer. For the case of polyamines comprising rings, a Y' unit of the formula

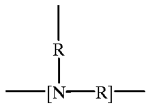

serves as a branch point for a backbone or branch ring. For every Y' unit there is a Y unit having the formula

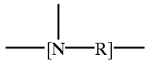

that will form the connection point of the ring to the main polymer chain or branch. In the unique case where the backbone is a complete ring, the polyamine backbone has the formula

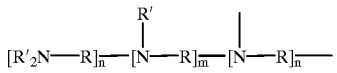

therefore comprising no Z terminal unit and having the formula $$V_{n-k}W_mY_nY'_k$$

wherein k is the number of ring forming branching units. Preferably the polyamine backbones of the present invention comprise no rings.

In the case of non-cyclic polyamines, the ratio of the index n to the index m relates to the relative degree of branching. A fully non-branched linear modified polyamine according to the present invention has the formula $$VW_mZ$$

that is, n is equal to 0. The greater the value of n (the lower the ratio of m to n), the greater the degree of branching in the molecule. Typically, the value for m ranges from a minimum value of 2 to 700, preferably 4 to 400, however, larger values of m are also preferred, especially when the value of the index n is very low or nearly 0.

Each polyamine nitrogen whether primary, secondary or tertiary, once modified according to the present invention, is further defined as being a member of one of three general classes; simple substituted, quaternized or oxidized. Those polyamine nitrogen units not modified are classed into V, W, Y, Y' or Z units depending on whether they are primary, secondary or tertiary nitrogens. That is unmodified primary amine nitrogens are V or Z units, unmodified secondary amine nitrogens are W units or Y' units and unmodified tertiary amine nitrogens are Y units for the purposes of the present invention.

Modified primary amine moieties are defined as V "terminal" units having one of three forms:

a) simple substituted units having the structure:

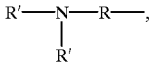

b) quaternized units having the structure:

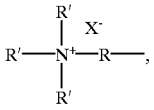

wherein X is a suitable counter ion providing charge balance; and c) oxidized units having the structure:

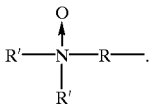

Modified secondary amine moieties are defined as W "backbone" units having one of three forms:

a) simple substituted units having the structure:

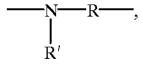

b) quaternized units having the structure:

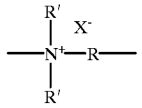

wherein X is a suitable counter ion providing charge balance; and c) oxidized units having the structure:

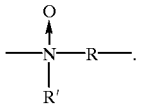

Other modified secondary amine moieties are defined as Y' units having one of three forms:

a) simple substituted units having the structure:

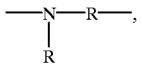

b) quaternized units having the structure:

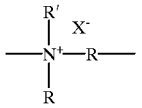

wherein X is a suitable counter ion providing charge balance; and c) oxidized units having the structure:

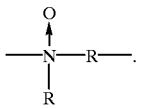

Modified tertiary amine moieties are defined as Y "branching" units having one of three forms:

a) unmodified units having the structure:

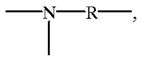

b) quaternized units having the structure:

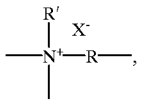

wherein X is a suitable counter ion providing charge balance; and c) oxidized units having the structure:

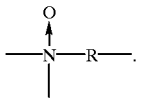

Certain modified primary amine moieties are defined as Z "terminal" units having one of three forms:

a) simple substituted units having the structure:

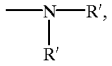

b) quaternized units having the structure:

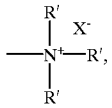

wherein X is a suitable counter ion providing charge balance; and c) oxidized units having the structure:

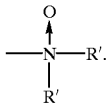

When any position on a nitrogen is unsubstituted of unmodified, it is understood that hydrogen will substitute for R'. For example, a primary amine unit comprising one R' unit in the form of a hydroxyethyl moiety is a V terminal unit having the formula $(HOCH_2CH_2)HN$—.

For the purposes of the present invention there are two types of chain terminating units, the V and Z units. The Z "terminal" unit derives from a terminal primary amino moiety of the structure —$NH_2$. Non-cyclic polyamine backbones according to the present invention comprise only one Z unit whereas cyclic polyamines can comprise no Z units. The Z "terminal" unit can be substituted with any of the R' units described further herein below, except when the Z unit is modified to form an N-oxide. In the case where the Z unit nitrogen is oxidized to an N-oxide, the nitrogen must be modified and therefore R' cannot be a hydrogen.

The polyamines of the present invention comprise backbone R "linking" units that serve to connect the nitrogen atoms of the backbone. R units comprise units that for the purposes of the present invention are referred to as "hydrocarbyl R" units and "oxy R" units. The "hydrocarbyl" R units are $C_2$–$C_{12}$ alkylene, $C_4$–$C_{12}$ alkenylene, $C_3$–$C_{12}$ hydroxyalkylene wherein the hydroxyl moiety may take any position on the R unit chain except the carbon atoms directly connected to the polyamine backbone nitrogens; $C_4$–$C_{12}$ dihydroxyalkylene wherein the hydroxyl moieties may occupy any two of the carbon atoms of the R unit chain except those carbon atoms directly connected to the polyamine backbone nitrogens; $C_8$–$C_{12}$ dialkylarylene which for the purpose of the present invention are arylene moieties having two alkyl substituent groups as part of the linking chain. For example, a dialkylarylene unit has the formula

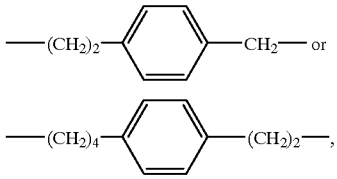

although the unit need not be 1,4-substituted, but can also be 1,2 or 1,3 substituted $C_2$–$C_{12}$ alkylene, preferably ethylene, 1,2-propylene, and mixtures thereof, more preferably ethylene. The "oxy" R units comprise —$(R^1O)_xR^5(OR^1)_x$—, —$CH_2CH(OR^2)CH_2O)_z(R^1O)_yR^1(OCH_2CH(OR^2)CH_2)_w$—, —$CH_2CH(OR^2)CH_2$—, —$(R^1O)_xR^1$—, and mixtures thereof. Preferred R units are selected from the group consisting of $C_2$–$C_{12}$ alkylene, $C_3$–$C_{12}$ hydroxyalkylene, $C_4$–$C_{12}$ dihydroxyalkylene, $C_8$–$C_{12}$ dialkylarylene, $(R^1O)_xR^1$—, —$CH_2CH(OR^2)CH_2$—, —$(CH_2CH(OH)CH_2O)_z(R^1O)_yR^1(OCH_2CH$—$(OH)CH_2)_w$—, —$(R^1O)_xR^5(OR^1)_x$—, more preferred R units are $C_2$–$C_{12}$ alkylene, $C_3$–$C_{12}$ hydroxy-alkylene, $C_4$–$C_{12}$ dihydroxyalkylene, —$(R^1O)_xR^1$—, —$(R^1O)_xR^5(OR^1)_x$—, —$(CH_2CH(OH)CH_2O)_z(R^1O)_yR^1(OCH_2CH$—$(OH)CH_2)_w$—, and mixtures thereof, even more preferred R units are $C_2$–$C_{12}$ alkylene, $C_3$ hydroxyalkylene, and mixtures thereof, most preferred are $C_2$–$C_6$ alkylene.

The most preferred backbones of the present invention comprise at least 50% R units that are ethylene.

$R^1$ units are $C_2$–$C_6$ alkylene, and mixtures thereof, preferably ethylene.

$R^2$ is hydrogen, and —$(R^1O)_xB$, preferably hydrogen.

$R^3$ is $C_1$–$C_{18}$ alkyl, $C_7$–$C_{12}$ arylalkylene, $C_7$–$C_{12}$ alkyl substituted aryl, $C_6$–$C_{12}$ aryl, and mixtures thereof, preferably $C_1$–$C_{12}$ alkyl, $C_7$–$C_{12}$ arylalkylene, more preferably $C_1$–$C_{12}$ alkyl, most preferably methyl. $R^3$ units serve as part of R' units described herein below.

$R^4$ is $C_1$–$C_{12}$ alkylene, $C_4$–$C_{12}$ alkenylene, $C_8$–$C_{12}$ arylalkylene, $C_6$–$C_{10}$ arylene, preferably $C_1$–$C_{10}$ alkylene, $C_8$–$C_{12}$ arylalkylene, more preferably $C_2$–$C_8$ alkylene, most preferably ethylene or butylene.

$R^5$ is $C_1$–$C_{12}$ alkylene, $C_3$–$C_{12}$ hydroxyalkylene, $C_4$–$C_{12}$ dihydroxyalkylene, $C_8$–$C_{12}$ dialkylarylene, —C(O)—, —C(O)NHR$^6$NHC(O)—, —C(O)$(R^4)_r$C(O)—, —$R^1(OR^1)$—, —$CH_2CH(OH)CH_2O(R^1O)_yR^1OCH_2CH(OH)CH_2$—, —C(O)$(R^4)_r$C(O)—, —$CH_2CH(OH)CH_2$—, $R^5$ is preferably ethylene, —C(O)—, —C(O)NHR$^6$NHC(O)—, —$R^1(OR^1)$—, —$CH_2CH(OH)CH_2$—, —$CH_2CH(OH)CH_2O(R^1O)_yR^1OCH_2CH$—$(OH)CH_2$—, more preferably —$CH_2CH(OH)CH_2$—.

$R^6$ is $C_2$–$C_{12}$ alkylene or $C_6$–$C_{12}$ arylene.

The preferred "oxy" R units are further defined in terms of the $R^1$, $R^2$, and $R^5$ units. Preferred "oxy" R units comprise the preferred $R^1$, $R^2$, and $R^5$ units. The preferred cotton soil release agents of the present invention comprise at least 50% $R^1$ units that are ethylene. Preferred $R^1$, $R^2$, and $R^5$ units are combined with the "oxy" R units to yield the preferred "oxy" R units in the following manner.

i) Substituting more preferred $R^5$ into —$(CH_2CH_2O)_xR^5(OCH_2CH_2)_x$— yields —$(CH_2CH_2O)_xCH_2CHOHCH_2(OCH_2CH_2)_x$—.

ii) Substituting preferred $R^1$ and $R^2$ into —$(CH_2CH(OR^2)CH_2O)_z$—$(R^1O)_yR^1O(CH_2CH(OR^2)CH_2)_w$— yields —$(CH_2CH(OH)CH_2O)_z$—$(CH_2CH_2O)_yCH_2CH_2O(CH_2CH(OH)CH_2)_w$—.

iii) Substituting preferred $R^2$ into —$CH_2CH(OR^2)CH_2$— yields —$CH_2CH(OH)CH_2$—.

R' units are selected from the group consisting of hydrogen, $C_1$–$C_{22}$ alkyl, $C_3$–$C_{22}$ alkenyl, $C_7$–$C_{22}$ arylalkyl, $C_2$–$C_{22}$ hydroxyalkyl, —$(CH_2)_pCO_2M$, —$(CH_2)_qSO_3M$, —$CH(CH_2CO_2M)CO_2M$, —$(CH_2)_pPO_3M$, —$(R^1O)_mB$, —C(O)$R^3$, preferably hydrogen, $C_2$–$C_{22}$ hydroxyalkylene, benzyl, $C_1$–$C_{22}$ alkylene, —$(R^1O)_mB$, —C(O)$R^3$, —$(CH_2)_pCO_2M$, —$(CH_2)_qSO_3M$, —$CH(CH_2CO_2M)CO_2M$, more preferably $C_1$–$C_{22}$ alkylene, —$(R^1O)_xB$, —C(O)$R^3$, —$(CH_2)_pCO_2M$, —$(CH_2)_qSO_3M$, —$CH(CH_2CO_2M)CO_2M$, most preferably $C_1$–$C_{22}$ alkylene, —$(R^1O)_xB$, and —C(O)$R^3$. When no modification or substitution is made on a nitrogen then the hydrogen atom will remain as the moiety representing R'.

R' units do not comprise a hydrogen atom when the V, W or Z units are oxidized, that is the nitrogens are N-oxides. For example, the backbone chain or branching chains do not comprise units of the following structure:

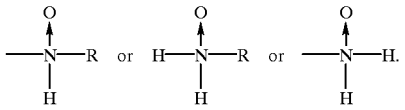

Additionally, R' units do not comprise carbonyl moieties directly bonded to a nitrogen atom when the V, W or Z units are oxidized, that is, the nitrogens are N-oxides. According to the present invention, the R' unit —C(O)$R^3$ moiety is not bonded to an N-oxide modified nitrogen, that is, there are no N-oxide amides having the structure

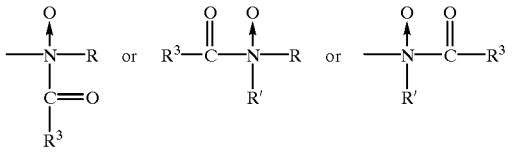

or combinations thereof.

B is hydrogen, $C_1$–$C_6$ alkyl, —$(CH_2)_qSO_3M$, —$(CH_2)_pCO_2M$, —$(CH_2)_q$—$(CHSO_3M)CH_2SO_3M$, —$(CH_2)_q(CHSO_2M)CH_2SO_3M$, —$(CH_2)_pPO_3M$, —$PO_3M$, preferably hydrogen, —$(CH_2)_qSO_3M$, —$(CH_2)_q(CHSO_3M)CH_2SO_3M$, —$(CH_2)_q$—$(CHSO_2M)CH_2SO_3M$, more preferably hydrogen or —$(CH_2)_qSO_3M$.

M is hydrogen or a water-soluble cation in sufficient amount to satisfy charge balance. For example, a sodium cation equally satisfies —$(CH_2)_pCO_2M$, and —$(CH_2)_qSO_3M$, thereby resulting in —$(CH_2)_pCO_2Na$, and —$(CH_2)_qSO_3Na$ moieties. More than one monovalent cation, (sodium, potassium, etc.) can be combined to satisfy the required chemical charge balance. However, more than one anionic group may be charge-balanced by a divalent cation, or more than one mono-valent cation may be necessary to satisfy the charge requirements of a poly-anionic radical. For example, a —$(CH_2)_pPO_3M$ moiety substituted with sodium atoms has the formula —$(CH_2)_pPO_3Na_3$. Divalent cations such as calcium ($Ca^{2+}$) or magnesium ($Mg^{2+}$) may be substituted for or combined with other suitable mono-valent water-soluble cations. Preferred cations are sodium and potassium, more preferred is sodium.

X is a water-soluble anion such as chlorine ($Cl^-$), bromine ($Br^-$) and iodine ($I^-$) or X can be any negatively-charged radical such as sulfate ($SO_4^{2-}$) and methosulfate ($CH_3SO_3^-$).

The formula indices have the following values: p has the value from 1 to 6, q has the value from 0 to 6; r has the value 0 or 1; w has the value 0 or 1, x has the value from 1 to 100; y has the value from 0 to 100; z has the value 0 or 1; m has the value from 2 to 700, preferably from 4 to 400, n has the value from 0 to 350, preferably from 0 to 200; m+n has the value of at least 5.

Preferably, x has a value lying in the range of from 1 to 20, preferably from 1 to 10.

The preferred amino-functional polymers of the present invention comprise polyamine backbones wherein less than 50% of the R groups comprise "oxy" R units, preferably less than 20%, more preferably less than 5%, most preferably the R units comprise no "oxy" R units.

The most preferred amino-functional polymers which comprise no "oxy" R units comprise polyamine backbones wherein less than 50% of the R groups comprise more than 3 carbon atoms. For example, ethylene, 1,2-propylene, and 1,3-propylene comprise 3 or less carbon atoms and are the preferred "hydrocarbyl" R units. That is when backbone R units are $C_2$–$C_{12}$ alkylene, preferred is $C_2$–$C_3$ alkylene, most preferred is ethylene.

The amino-functional polymers of the present invention comprise modified homogeneous and non-homogeneous polyamine backbones, wherein 100% or less of the —NH units are modified. For the purpose of the present invention the term "homogeneous polyamine backbone" is defined as a polyamine backbone having R units that are the same (i.e., all ethylene). However, this sameness definition does not exclude polyamines that comprise other extraneous units comprising the polymer backbone which are present due to an artifact of the chosen method of chemical synthesis. For example, it is known to those skilled in the art that ethanolamine may be used as an "initiator" in the synthesis of polyethyleneimines, therefore a sample of polyethyleneimine that comprises one hydroxyethyl moiety resulting from the polymerization "initiator" would be considered to comprise a homogeneous polyamine backbone for the purposes of the present invention. A polyamine backbone comprising all ethylene R units wherein no branching Y units are present is a homogeneous backbone. A polyamine backbone comprising all ethylene R units is a homogeneous backbone regardless of the degree of branching or the number of cyclic branches present.

For the purposes of the present invention the term "non-homogeneous polymer backbone" refers to polyamine backbones that are a composite of various R unit lengths and R unit types. For example, a non-homogeneous backbone comprises R units that are a mixture of ethylene and 1,2-propylene units. For the purposes of the present invention a mixture of "hydrocarbyl" and "oxy" R units is not necessary to provide a non-homogeneous backbone.

Preferred amino-functional polymers of the present invention comprise homogeneous polyamine backbones that are totally or partially substituted by polyethyleneoxy moieties, totally or partially quaternized amines, nitrogens totally or partially oxidized to N-oxides, and mixtures thereof. However, not all backbone amine nitrogens must be modified in the same manner, the choice of modification being left to the specific needs of the formulator. The degree of ethoxylation is also determined by the specific requirements of the formulator.

The preferred polyamines that comprise the backbone of the compounds of the present invention are generally polyalkyleneimines (PAI's), preferably polyethyleneimines (PEI's), or PEI's connected by moieties having longer R units than the parent PAI's or PEI's.

Preferred amine polymer backbones comprise R units that are $C_2$ alkylene (ethylene) units, also known as polyethylenimines (PEI's). Preferred PEI's have at least moderate branching, that is the ratio of m to n is less than 4:1, however PEI's having a ratio of m to n of 2:1 are most preferred. Preferred backbones, prior to modification have the general formula:

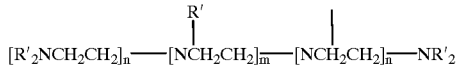

wherein R', m and n are the same as defined hereinabove. Preferred PEI's will have a molecular weight greater than 200 daltons.

The relative proportions of primary, secondary and tertiary amine units in the polyamine backbone, especially in the case of PEI's, will vary, depending on the manner of preparation. Each hydrogen atom attached to each nitrogen atom of the polyamine backbone chain represents a potential site for subsequent substitution, quaternization or oxidation.

These polyamines can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing these polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951; all herein incorporated by reference.

Examples of amino-functional polymers comprising PEI's, are illustrated in Formulas I–IV:

Formula I depicts an amino-functional polymer comprising a PEI backbone wherein all substitutable nitrogens are modified by replacement of hydrogen with a polyoxyalkyleneoxy unit, —$(CH_2CH_2O)7H$, having the formula Formula I

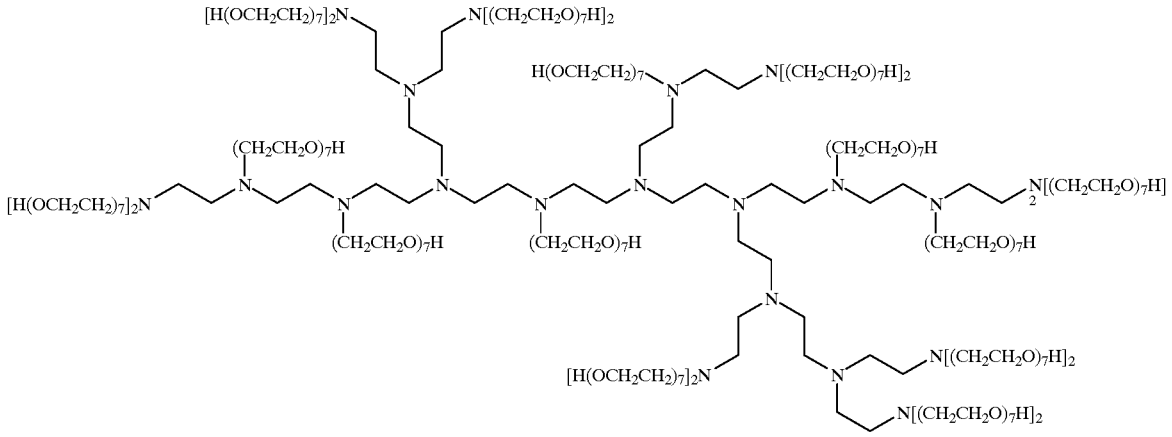

This is an example of an amino-functional polymer that is fully modified by one type of moiety.

Formula II depicts an amino-functional polymer comprising a PEI backbone wherein all substitutable primary amine nitrogens are modified by replacement of hydrogen with a polyoxyalkyleneoxy unit, —$(CH_2CH_2O)_7H$, the molecule is then modified by subsequent oxidation of all oxidizable primary and secondary nitrogens to N-oxides, said polymer having the formula Formula II

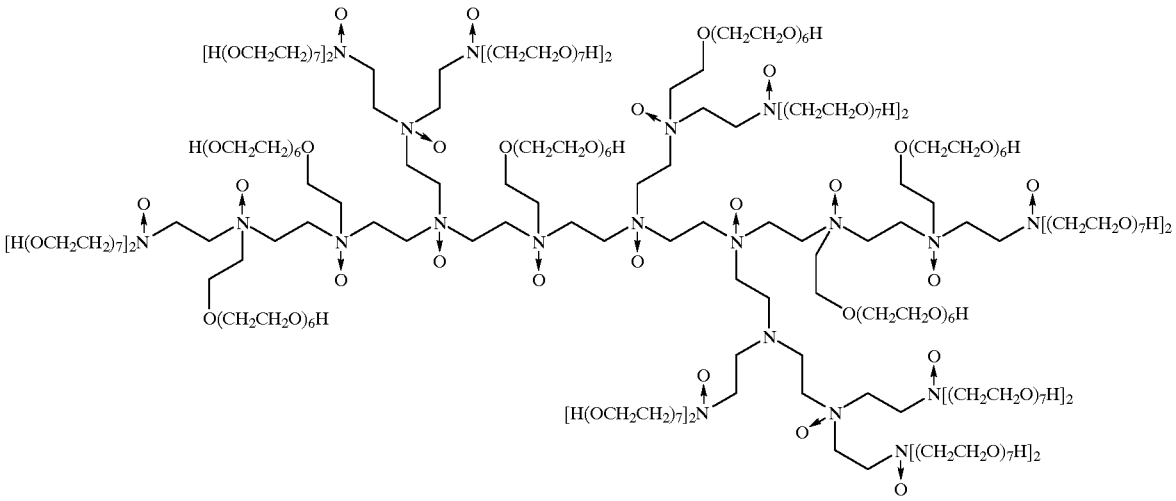

Formula III depicts an amino-functional polymer comprising a PEI backbone wherein all backbone hydrogen atoms are substituted and some backbone amine units are quaternized. The substituents are polyoxyalkyleneoxy units, —$(CH_2CH_2O)_7H$, or methyl groups. The modified PEI has the formula Formula IV depicts an amino-functional polymer comprising a PEI backbone wherein the backbone nitrogens are modified by substitution (i.e. by —$(CH_2CH_2O)_7H$ or methyl), quaternized, oxidized to N-oxides or combinations thereof. The resulting polymer has the formula Formula III

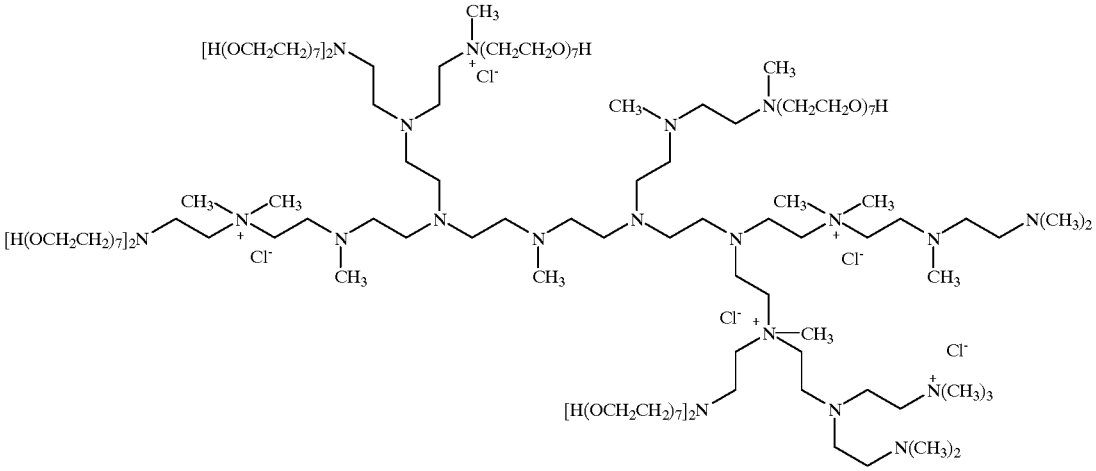

Formula IV

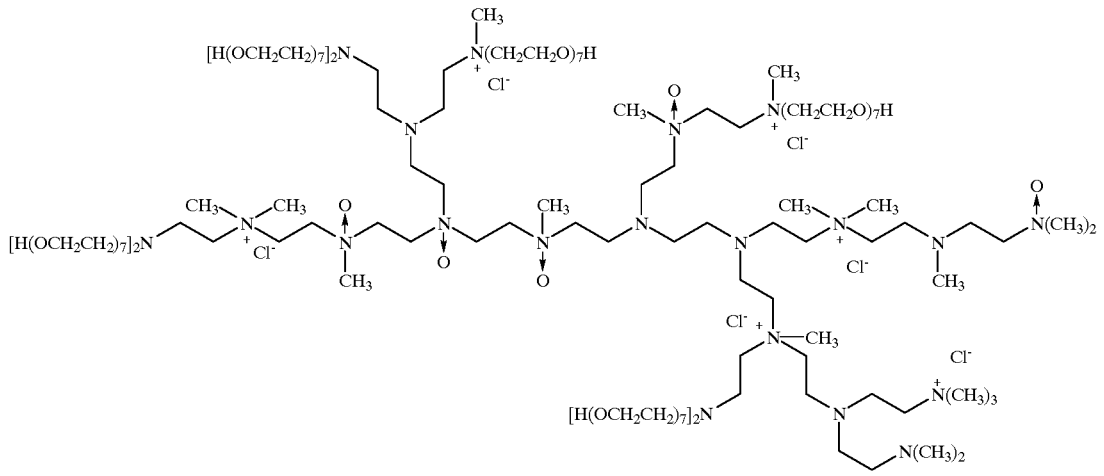

In the above examples, not all nitrogens of a unit class comprise the same modification. The present invention allows the formulator to have a portion of the secondary amine nitrogens ethoxylated while having other secondary amine nitrogens oxidized to N-oxides. This also applies to the primary amine nitrogens, in that the formulator may choose to modify all or a portion of the primary amine nitrogens with one or more substituents prior to oxidation or quaternization. Any possible combination of R' groups can be substituted on the primary and secondary amine nitrogens, except for the restrictions described hereinabove.

Commercially available amino-functional polymer suitable for use herein are poly(ethyleneimine) with a MW1200, hydroxyethylated poly(ethyleneimine) from Polysciences, with a. MW2000, and 80% hydroxyethylated poly (ethyleneimine ) from Aldrich.

A typical amount of amino-functional polymer to be employed in the composition of the invention is preferably up to 90% by weight, preferably from 0.01% to 50% active by weight, more preferably from 0.1% to 20% by weight and most preferably from 0.5% to 5% by weight of the composition.

The composition may also contain optional components which may be suitable for further improving the aesthetic appearance of the fabrics treated therewith. Suitable optional components include a polyolefin dispersion, a fabric softener component, additional components and mixtures thereof.

For optimum performance of the compositions, the compositions of the invention comprise the dye fixing agent and the amino-functional polymer in a weight ratio of dye fixing agent to amino-functional polymer of from 100:1 to 0.01:1, preferably of from 10:1 to 0.1:1, more preferably of from 2:1 to 0.5:1.

Polyolefin dispersion

A polyolefin dispersion may optionally be used in the composition of the invention in order to provide anti-wrinkles and improved water absorbency benefits to the fabrics. Preferably, the polyolefin is a polyethylene, polypropylene or mixtures thereof. The polyolefin may be at least partially modified to contain various functional groups, such as carboxyl, carbonyl, ester, ether, alkylamide, sulfonic acid or amide groups. More preferably, the polyolefin employed in the present invention is at least partially carboxyl modified or, in other words, oxidized. In particular, oxidized or carboxyl modified polyethylene is preferred in the compositions of the present invention.

For ease of formulation, the polyolefin is preferably introduced as a suspension or an emulsion of polyolefin dispersed by use of an emulsifing agent. The polyolefin suspension or emulsion preferably has from 1% to 50%, more preferably from 10% to 35% by weight, and most preferably from 15% to 30% by weight of polyolefin in the emulsion. The polyolefin preferably has a molecular weight of from 1,000 to 15,000 and more preferably from 4,000 to 10,000.

When an emulsion is employed, the emulsifier may be any suitable emulsification or suspending agent. Preferably, the emulsifier is a cationic, nonionic, zwitterionic or anionic surfactant or mixtures thereof.

Most preferably, any suitable cationic, nonionic or anionic surfactant may be employed as the emulsifier. Preferred emulsifiers are cationic surfactants such as the fatty amine surfactants and in particular the ethoxylated fatty amine surfactants. In particular, the cationic surfactants are preferred as emulsifiers in the present invention. The polyolefin is dispersed with the emulsifier or suspending agent in a ratio of emulsifier to polyolefin of from 1:10 to 3:1. Preferably, the emulsion includes from 0.1% to 50%, more preferably from 1% to 20% and most preferably from 2.5% to 10% by weight of emulsifier in the polyolefin emulsion. Polyethylene emulsions and suspensions suitable for use in the present invention are available under the tradename VELUSTROL from HOECHST Aktiengesellschaft of Frankfurt am Main, Germany. In particular, the polyethylene emulsions sold under the tradename VELUSTROL PKS, VELUSTROL KPA, or VELUSTROL P-40 may be employed in the compositions of the present invention.

The compositions of the present invention contain from 0.01% to 8% by weight of the dispersible polyolefin. More preferably, the compositions include from 0.1% to 5% by weight and most preferably from 0.1% to 3% by weight of the polyolefin. When the polyolefin is added to the compositions of the present invention as an emulsion or suspension, the emulsion or suspension is added at sufficient enough quantities to provide the above noted levels of dispersible polyolefin in the compositions.

Fabric softener component

A fabric softener component may also suitably be used in the composition of the invention so as to provide softness and antistastic properties to the treated fabrics. When used, the fabric softener component will typically be present at a level sufficient to provide softening and antistatic properties. Typical levels are those conventionally used in fabric softening compositions, i.e from 1% to 99% by weight of the composition. Depending on the composition execution, i.e liquid or solid, the composition will preferably comprise a level of fabric softening components for liquid compositions of from 1% to 5% by weight for the diluted compositions or from 5% to 80%, more preferably 10% to 50%, most preferably 15% to 35% by weight for concentrated compositions. Where nonionic fabric softener components are present, the level of nonionic softener component in the composition will typically be from 0.1% to 10%, preferably from 1% to 5% by weight.

Where the composition comprising the softener component is applied on a substrate such as a dryer-sheet, the preferred level of fabric softener component will preferably be from 20% to 99%, more preferably from 30% to 90% by weight, and even more preferably from 35% to 85% by weight.

Said fabric softening component may be selected from cationic, nonionic, amphoteric or anionic fabric softening component.

The preferred, typical cationic fabric softening components include the water-insoluble quaternary-ammonium fabric softening actives, the most commonly used having been di-long alkyl chain ammonium chloride or methyl sulfate.

Preferred cationic softeners among these include the following:

1) ditallow dimethylammonium chloride (DTDMAC);
2) dihydrogenated tallow dimethylammonium chloride;
3) dihydrogenated tallow dimethylammonium methylsulfate;
4) distearyl dimethylammonium chloride;
5) dioleyl dimethylammonium chloride;
6) dipalmityl hydroxyethyl methylammonium chloride;
7) stearyl benzyl dimethylammonium chloride;
8) tallow trimethylammonium chloride;
9) hydrogenated tallow trimethylammonium chloride;
10) $C_{12-14}$ alkyl hydroxyethyl dimethylammonium chloride;
11) $C_{12-18}$ alkyl dihydroxyethyl methylammonium chloride;
12) di(stearoyloxyethyl) dimethylammonium chloride (DSOEDMAC);
13) di(tallowoyloxyethyl) dimethylammonium chloride;
14) ditallow imidazolinium methylsulfate;
15) 1-(2-tallowylamidoethyl)-2-tallowyl imidazolinium methylsulfate.

However, in recent years, the need has arisen for more environmental-friendly materials, and rapidly biodegradable quaternary ammonium compounds have been presented as alternatives to the traditionally used di-long alkyl chain ammonium chlorides and methyl sulfates. Said materials and fabric softening compositions containing them are disclosed in numerous publications such as EP-A-0,040,562, and EP-A-0,239,910.

The quaternary ammonium compounds and amine precursors herein have the formula (1) or (1 1), below (I)

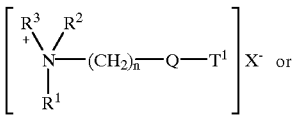

-continued (II)

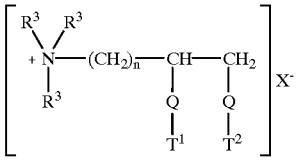

wherein Q is selected from —O—C(O)—, —C(O)—O—, —O—C(O)—O—, —$NR^4$—C(O)—, —C(O)—$NR^4$—;

$R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1$, $T^2$, $T^3$, $T^4$, $T^5$ are independently $C_{11}$–$C_{22}$ alkyl or alkenyl;

n and m are integers from 1 to 4; and $X^-$ is a softener-compatible anion.

Non-limiting examples of softener-compatible anions include chloride or methyl sulfate.

The alkyl, or alkenyl, chain $T^1$, $T^2$, $T^3$, $T^4$, $T^5$ must contain at least 11 carbon atoms, preferably at least 16 carbon atoms. The chain may be straight or branched.

Tallow is a convenient and inexpensive source of long chain alkyl and alkenyl material. The compounds wherein $T^1$, $T^2$, $T^3$, $T^4$, $T^5$ represent the mixture of long chain materials typical for tallow are particularly preferred.

Specific examples of quaternary ammonium compounds suitable for use in the aqueous fabric softening compositions herein include 1) N,N-di(tallowyl-oxy-ethyl)-N,N-dimethyl ammonium chloride;
2) N,N-di(tallowyl-oxy-ethyl)-N-methyl, N-(2-hydroxyethyl) ammonium methyl sulfate;
3) N,N-di(2-tallowyl-oxy-2-oxo-ethyl)-N,N-dimethyl ammonium chloride;
4) N,N-di(2-tallowyl-oxy-ethylcarbonyl-oxy-ethyl)-N,N-dimethyl ammonium chloride;
5) N-(2-tallowyl-oxy-2-ethyl)-N-(2-tallowyl-oxy-2-oxo-ethyl)-N,N-dimethyl ammonium chloride;
6) N,N,N-tri(tallowyl-oxy-ethyl)-N-methyl ammonium chloride;
7) N-(2-tallowyl-oxy-2-oxo-ethyl)-N-(tallowyl-N,N-dimethyl-ammonium chloride; and
8) 1,2-ditallowyl-oxy-3-trimethylammoniopropane chloride;

and mixtures of any of the above materials.

Of these, compounds 1–7 are examples of compounds of Formula (I); compound 8 is a compound of Formula (II).

Particularly preferred is N,N-di(tallowyl-oxy-ethyl)-N,N-dimethyl ammonium chloride, where the tallow chains are at least partially unsaturated.

The level of unsaturation of the tallow chain can be measured by the Iodine Value (IV) of the corresponding fatty acid, which in the present case should preferably be in the range of from 5 to 100 with two categories of compounds being distinguished, having a IV below or above 25.

Indeed, for compounds of Formula (I) made from tallow fatty acids having a IV of from 5 to 25, preferably 15 to 20, it has been found that a cis/trans isomer weight ratio greater than 30/70, preferably greater than 50/50 and more preferably greater than 70/30 provides optimal concentrability.

For compounds of Formula (I) made from tallow fatty acids having a IV of above 25, the ratio of cis to trans isomers has been found to be less critical unless very high concentrations are needed.

Other examples of suitable quaternary ammoniums of Formula (I) and (II) are obtained by, e.g.:

replacing "tallow" in the above compounds with, for example, coco, palm, lauryl, oleyl, ricinoleyl, stearyl, palmityl, or the like, said fatty acyl chains being either fully saturated, or preferably at least partly unsaturated;

replacing "methyl" in the above compounds with ethyl, ethoxy, propyl, propoxy, isopropyl, butyl, isobutyl or t-butyl;

replacing "chloride" in the above compounds with bromide, methylsulfate, formate, sulfate, nitrate, and the like.

In fact, the anion is merely present as a counterion of the positively charged quaternary ammonium compounds. The nature of the counterion is not critical at all to the practice of the present invention. The scope of this invention is not considered limited to any particular anion.

By "amine precursors thereof" is meant the secondary or tertiary amines corresponding to the above quaternary ammonium compounds, said amines being substantially protonated in the present compositions due to the pH values.

Additional fabric softening materials may be used in addition or alternatively to the cationic fabric softener. These may be selected from nonionic, amphoteric or anionic fabric softening material. Disclosure of such materials may be found in U.S. Pat. No. 4,327,133; U.S. Pat. No. 4,421,792; U.S. Pat. No. 4,426,299; U.S. Pat. No. 4,460,485; U.S. Pat. No. 3,644,203; U.S. Pat. No. 4,661,269; U.S. Pat. No. 4,439,335; U.S. Pat. No. 3,861,870; U.S. Pat. No. 4,308,151; U.S. Pat. No. 3,886,075; U.S. Pat. No. 4,233,164; U.S. Pat. No. 4,401,578; U.S. Pat. No. 3,974,076; U.S. Pat. No. 4,237,016 and EP 472,178.

Typically, such nonionic fabric softener materials have an HLB of from 2 to 9, more typically from 3 to 7. Such nonionic fabric softener materials tend to be readily dispersed either by themselves, or when combined with other materials such as single-long-chain alkyl cationic surfactant described in detail hereinafter. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g. >40° C.) and relatively water-insoluble.

Preferred nonionic softeners are fatty acid partial esters of polyhydric alcohols, or anhydrides thereof, wherein the alcohol, or anhydride, contains from 2 to 18, preferably from 2 to 8, carbon atoms, and each fatty acid moiety contains from 12 to 30, preferably from 16 to 20, carbon atoms. Typically, such softeners contain from one to 3, preferably 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred.

The fatty acid portion of the ester is normally derived from fatty acids having from 12 to 30, preferably from 16 to 20, carbon atoms, typical examples of said fatty acids being lauric acid, myristic acid, palmitic acid, stearic acid and behenic acid.

Highly preferred optional nonionic softening agents for use in the present invention are the sorbitan esters, which are esterified dehydration products of sorbitol, and the glycerol esters.

Commercial sorbitan monostearate is a suitable material. Mixtures of sorbitan stearate and sorbitan palmitate having stearate/palmitate weight ratios varying between 10:1 and 1:10, and 1,5-sorbitan esters are also useful.

Glycerol and polyglycerol esters, especially glycerol, diglycerol, triglycerol, and polyglycerol mono- and/or di-esters, preferably mono-, are preferred herein (e.g. polyglycerol monostearate with a trade name of Radiasurf 7248).

Useful glycerol and polyglycerol esters include monoesters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

Further fabric softening components suitable for use herein are the softening clays, such as the low ion-exchange-capacity ones described in EP-A-0,150,531.

For the preceding fabric softening agents, especially with biodegradable fabric softening agents, the pH of the liquid compositions herein is an essential parameter of the present invention. Indeed, it influences the stability of the quaternary ammonium or amine precursors compounds, especially in prolonged storage conditions. The pH, as defined in the present context, is measured in the neat compositions at 20° C. For optimum hydrolytic stability of these compositions, the neat pH, measured in the above-mentioned conditions, must be in the range of from 2.0 to 4.5. Preferably, where the liquid fabric softening compositions of the invention are in a concentrated form, the pH of the neat composition is in the range of 2.0 to 3.5, while if it is in a diluted form, the pH of the neat composition is in the range of 2.0 to 3.0. The pH of these compositions herein can be regulated by the addition of a Bronsted acid.

Examples of suitable acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids.

Additional components

The composition may also optionally contain additional components such as enzymes, surfactant concentration aids, electrolyte concentration aids, stabilisers, such as well-known antioxidants and reductive agents, soil release polymers, emulsifiers, bacteriocides, colorants, perfumes, preservatives, optical brighteners, anti-ionisation agents, and antifoam agents and mixtures thereof. These ingredients, especially the minor ingredients, and especially perfume, can be usefully added with, and preferably protected by, "carrier materials" such as zeolites, starch, cyclodextrin, wax, etc.

Enzymes

The composition herein can optionally employ one or more enzymes such as lipases, proteases, cellulase, amylases and peroxidases. A preferred enzyme for use herein is a cellulase enzyme. Indeed, this type of enzyme will further provide a color care benefit to the treated fabric. Cellulases usable herein include both bacterial and fungal types, preferably having a pH optimum between 5 and 9.5. U.S. Pat. No. 4,435,307, Barbesgoard et al, Mar. 6, 1984, discloses suitable fungal cellulases from *Humicola insolens* or Humicola strain DSM1800 or a cellulase 212-producing fungus belonging to the genus Aeromonas, and cellulase extracted from the hepatopancreas of a marine mollusk, *Dolabella Auricula Solander.*

Suitable cellulases are also disclosed in GB-A-2.075.028; GB-A-2.095.275 and DE-OS-2.247.832. CAREZYME® and CELLUZYME® (Novo) are especially useful. Other suitable cellulases are also disclosed in WO 91/17243 to Novo, WO 96/34092, WO 96/34945 and EP-A-0,739,982.

In practical terms for current commercial preparations, typical amounts are up to about 5 mg by weight, more typically 0.01 mg to 3 mg, of active enzyme per gram of the composition. Stated otherwise, the compositions herein will typically comprise from 0.001% to 5%, preferably 0.01%–1% by weight of a commercial enzyme preparation. In the particular cases where activity of the enzyme preparation can be defined otherwise such as with cellulases, corresponding activity units are preferred (e.g. CEVU or cellulase Equivalent Viscosity Units). For instance, the compositions of the present invention can contain cellulase enzymes at a level equivalent to an activity from about 0.5 to 1000 CEVU/gram of composition. Cellulase enzyme preparations used for the purpose of formulating the compositions of this invention typically have an activity comprised between 1,000 and 10,000 CEVU/gram in liquid form, around 1,000 CEVU/gram in solid form.

Surfactant concentration aids

Surfactant concentration aids may also optionally be used. When used, said surfactant concentration aid will help achieving the desired finished product viscosity as well as stabilising the finished product upon storage. Surfactant concentration aids are typically selected from single long chain alkyl cationic surfactants, nonionic alkoxylated surfactants, amine oxides, fatty acids, and mixtures thereof, typically used at a level of from 0 to 15% by weight of the composition.

Single long chain alkyl cationic surfactants

Such mono-long-chain-alkyl cationic surfactants useful in the present invention are, preferably, quaternary ammonium salts of the general formula:

$$[R^2N+R^3]X^-$$

wherein the $R^2$ group is $C_{10}$–$C_{22}$ hydrocarbon group, preferably $C_{12}$–$C_{18}$ alkyl group of the corresponding ester linkage interrupted group with a short alkylene ($C_1$–$C_4$) group between the ester linkage and the N, and having a similar hydrocarbon group, e.g., a fatty acid ester of choline, preferably $C_{12}$–$C_{14}$ (coco) choline ester and/or $C_{16}$–$C_{18}$ tallow choline ester at from 0.1% to 20% by weight of the softener active. Each R is a $C_1$–$C_4$ alkyl or substituted (e.g., hydroxy) alkyl, or hydrogen, preferably methyl, and the counterion $X^-$ is a softener compatible anion, for example, chloride, bromide, methyl sulfate, etc.

Other cationic materials with ring structures such as alkyl imidazoline, imidazolinium, pyridine, and pyridinium salts having a single $C_{12}$–$C_{30}$ alkyl chain can also be used. Very low pH is required to stabilize, e.g., imidazoline ring structures.

Some alkyl imidazolinium salts and their imidazoline precursors useful in the present invention have the general formula:

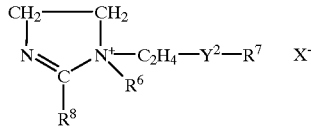

wherein $Y^2$ is —C(O)—O—, —O—(O)C—, —C(O)—N($R^5$)—, or —N($R^5$)—C(O)— in which $R^5$ is hydrogen or a $C_1$–$C_4$ alkyl radical; $R^6$ is a $C_1$–$C_4$ alkyl radical or H (for imidazoline precursors); $R^7$ and $R^8$ are each independently selected from R and $R^2$ as defined hereinbefore for the single-long-chain cationic surfactant with only one being $R^2$.

Some alkyl pyridinium salts useful in the present invention have the general formula:

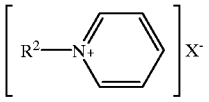

wherein $R^2$ and X- are as defined above. A typical material of this type is cetyl pyridinium chloride.

Nonionic Alkoxylated Surfactant

Suitable nonionic alkoxylated surfactants for use herein include addition products of ethylene oxide and, optionally, propylene oxide, with fatty alcohols, fatty acids and fatty amines.

Suitable compounds are substantially water-soluble surfactants of the general formula:

$$R^2—Y—(C_2H_4O)_z—C_2H_4OH$$

wherein $R^2$ is selected from primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of up to 20, preferably from 10 to 18 carbon atoms.

Y is typically —O—, —C(O)O—, —C(O)N(R)—, or —C(O)N(R)R—, in which $R^2$ and R, when present, have the meanings given hereinbefore, and/or R can be hydrogen, and z is of from 5 to 50, preferably of from 1- to 30.

The nonionic surfactants herein are characterized by an HLB (hydrophilic-lipophilic balance) of from 7 to 20, preferably from 8 to 15.

Examples of particularly suitable nonionic surfactants include

Straight-Chain, Primary Alcohol Alkoxylates such as tallow alcohol-EO(11), tallow alcohol-EO(18), and tallow alcohol-EO(25);

Straight-Chain, Secondary Alcohol Alkoxylates such as 2-$C_{16}$EO(11); 2-$C_{20}$EO(11); and 2-$C_{16}$EO(14);

Alkyl Phenol Alkoxylates, such as p-tridecylphenol EO(11 ) and p-pentadecylphenol EO(18), as well as Olefinic Alkoxylates, and Branched Chain Alkoxylates such as branched chain primary and secondary alcohols which are available from the well-known "OXO" process.

Amine Oxides

Suitable amine oxides include those with one alkyl or hydroxyalkyl moiety of 8 to 28 carbon atoms, preferably from 8 to 16 carbon atoms, and two alkyl moieties selected from alkyl groups and hydroxyalkyl groups with 1 to 3 carbon atoms.

Examples include dimethyloctylamine oxide, diethyldecylamine oxide, bis-(2-hydroxyethyl)dodecylamine oxide, dimethyldodecyl-amine oxide, dipropyltetradecylamine oxide, methylethylhexadecylamine oxide, dimethyl-2-hydroxyoctadecylamine oxide, and coconut fatty alkyl dimethylamine oxide.

Fatty Acids

Suitable fatty acids include those containing from 12 to 25, preferably from 16 to 20 total carbon atoms, with the fatty moiety containing from 10 to 22, preferably from 15 to 17 (mid cut), carbon atoms.

A preferred surfactant concentration aid for use herein is a nonionic alkoxylated surfactant. When used, such nonionic alkoxylated surfactant will be present in an amount of 0.01% to 10% by weight, preferably from 0.05% to 2% by weight of the composition. Most preferably, for optimum stabilisation of the composition, the composition of the invention has a weight ratio of amino-functional polymer to nonionic alkoxylated surfactant of from 500:1 to 0.5:1, preferably of from 30:1 to 1:1.

Electrolyte Concentration Aids

Inorganic viscosity control agents which can also act like or augment the effect of the surfactant concentration aids, include water-soluble, ionizable salts which can also optionally be incorporated into the compositions of the present invention. Incorporation of these components to the composition must be processed at a very slow rate.

A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from 20 to 20,000 parts per million (ppm), preferably from 20 to 11,000 ppm, by weight of the composition.

Alkylene polyammonium salts can be incorporated into the composition to give viscosity control in addition to or in place of the water-soluble, ionizable salts above. In addition, these agents can act as scavengers, forming ion pairs with anionic detergent carried over from the main wash, in the rinse, and on the fabrics, and may improve softness performance. These agents may stabilise the viscosity over a broader range of temperature, especially at low temperatures, compared to the inorganic electrolytes.

Specific examples of alkylene polyammonium salts include I-lysine monohydrochloride and 1,5-diammonium 2-methyl pentane dihydrochloride.

Another optional ingredient is a liquid carrier. Suitable liquid carriers are selected from water, organic solvents and mixtures thereof. The liquid carrier employed in the instant compositions is preferably at least primarily water due to its low cost relative availability, safety, and environmental compatibility. The level of water in the liquid carrier is preferably at least 50%, most preferably at least 60%, by weight of the carrier. Mixtures of water and low molecular weight, e.g., <200, organic solvent, e.g., lower alcohol such as ethanol, propanol, isopropanol or butanol are useful as the carrier liquid. Low molecular weight alcohols include monohydric, dihydric (glycol, etc.) trihydric (glycerol, etc.), and higher polyhydric (polyols) alcohols.

Method

In another aspect of the invention, there is provided a method for providing color care to fabrics upon domestic laundering treatment which comprises the step of contacting the fabrics with an aqueous medium comprising a composition as defined hereinbefore. Preferably, said aqueous medium is at a temperature between 2° C. to 40° C., more preferably between 5° C. to 25° C.

In a further aspect of the invention, the composition of the invention may be applied on a substrate, such as a dryer-sheet. Accordingly, there is also provided a method for providing color care on treated fabrics upon domestic treatment which comprises the step of contacting the fabrics with a composition as defined hereinbefore, wherein said composition is applied on a substrate, preferably a dryer-sheet. Preferably, where the composition of the invention is applied on a dryer-sheet, the compositions are used in tumble-drying processes.

By "color care" is meant that fabrics which have been in contact with an aqueous solution of a composition comprising a combination of a dye fixing agent and an amino-functional polymer, as defined hereinbefore, and after, and/or prior and/or simultaneously washed with a detergent composition exhibit a better fabric color appearance compared to fabrics which have not been contacted with said composition.

Applications

The compositions of the invention are suitable for use in different applications such as a pre-treatment composition prior to the laundering of the fabrics, as a wash additive, as a composition suitable for use in the rinse-cycle of the laundry cycle or applied on a dryer-sheet. The compositions of the invention may also be in a spray, foam, or aerosol form which for example can be suitable for use while ironing, or applied on the surfaces of the tumble dryer.

The color care benefit may either be assessed visually or by determination of the so-called delta-E values.

When the visual assessment is used, a panel of expert graders visually compare, according to the established panel score unit (PSU) scales, fabrics treated with and without the composition according to the present invention. A positive PSU value indicates a better performance (PSU scale: 0=no difference, 1=I think there is a difference, 2=I know there is a difference, 3=I know there is a lot of difference, 4=I know there is a whole lot of difference ).

Another method for the assessment of the color care benefit to fabrics is the determination of the so-called delta-E values. Delta E's are defined, for instance, in ASTM D2244. Delta E is the computed color difference as defined in ASTM D2244, i.e the magnitude and direction of the difference between two psychophysical color stimuli defined by tristimulus values, or by chromaticity coordinates and luminance factor, as computed by means of a specified set of color-difference equations defined in the CIE 1976 CIELAB opponent-color space, the Hunter opponent-color space, the Friele-Mac Adam-Chickering color space or any equivalent color space.

The invention is illustrated in the following non-limiting examples, in which all percentages are on an active weight basis unless otherwise stated.

In the examples, the abbreviated component identifications have the following meanings:

DEQA: Di-(tallowyl-oxy-ethyl) dimethyl ammonium chloride

DOEQA: Di-(oleyloxyethyl) dimethyl ammonium methylsulfate

DTDMAC: Ditallow dimethylammonium chloride

DHEQA: Di-(soft-tallowyl-oxy-ethyl) hydroxyethyl methyl ammonium methylsulfate

Fatty acid: Stearic acid of IV=0

Electrolyte: Calcium chloride

DTDMAMS: Ditallow dimethyl ammonium methylsulfate

SDASA: 1:2 Ratio of stearyldimethyl amine:triple-pressed stearic acid

Glycosperse S-20: Polyethoxylated sorbitan monostearate available from Lonza

Clay: Calcium Bentonite Clay, Bentonite L, sold by Southern Clay Products

Neodol 45-13: $C_{14}$–$C_{15}$ linear primary alcohol ethoxylate, sold by Shell Chemical Co TAE25: Tallow alcohol ethoxylated with 25 moles of ethylene oxide per mole of alcohol PEG: Polyethylene Glycol 4000

PEI: Solution of polyethylene imine (MW 2000, at 50% active) available under the tradename Lupasol G35 from BASF PEI 1800 E1: Ethoxylated polyethylene imine (MW 1800, at 50% active) as synthesised in Synthesis example 1

PEI 1200 E1: Ethoxylated polyethylene imine (MW 1200, at 50% active in water) as synthesised in Synthesis example 5

Dye Fix 1: Cationic dye fixing agent (50% active) available under the tradename Tinofix Eco from Ciba-Geigy Dye Fix 2: Emulsified cationic dye fixative (30% active) available under the tradename Rewin SRF-O from CHT-Beitlich Carezyme: cellulytic enzyme sold by NOVO Industries A/S

SYNTHESIS EXAMPLE 1

Preparation of PEI 1800 $E_1$

Step A)

The ethoxylation is conducted in a 2 gallon stirred stainless steel autoclave equipped for temperature measurement and control, pressure measurement, vacuum and inert gas purging, sampling, and for introduction of ethylene oxide as a liquid. A ~20 lb. net cylinder of ethylene oxide (ARC) is set up to deliver ethylene oxide as a liquid by a pump to the autoclave with the cylinder placed on a scale so that the weight change of the cylinder could be monitored.

A 750 g portion of polyethyleneimine (PEI) (Nippon Shokubai, Epomin SP-018 having a listed average molecular weight of 1800 equating to 0.417 moles of polymer and 17.4 moles of nitrogen functions) is added to the autoclave. The autoclave is then sealed and purged of air (by applying vacuum to minus 28" Hg followed by pressurization with nitrogen to 250 psia, then venting to atmospheric pressure). The autoclave contents are heated to 130° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned off and cooling is applied to limit any temperature increase resulting from any reaction exotherm. The temperature is maintained between 100° C. and 110° C. while the total pressure is allowed to gradually increase during the course of the reaction. After a total of 750 grams of ethylene oxide has been charged to the autoclave (roughly equivalent to one mole ethylene oxide per PEI nitrogen function), the temperature is increased to 110° C. and the autoclave is allowed to stir for an additional hour. At this point, vacuum is applied to remove any residual unreacted ethylene oxide.

Step B)

The reaction mixture is then deodorized by passing about 100 cu. ft. of inert gas (argon or nitrogen) through a gas dispersion frit and through the reaction mixture while agitating and heating the mixture to 130° C.

The final reaction product is cooled slightly and collected in glass containers purged with nitrogen.

In other preparations the neutralization and deodorization is accomplished in the reactor before discharging the product.

If a PEI 1800 $E_7$ is desired, the following step of catalyst addition will be included between Step A and B.

Vacuum is continuously applied while the autoclave is cooled to about 50° C. while introducing 376 g of a 25% sodium methoxide in methanol solution (1.74 moles, to achieve a 10% catalyst loading based upon PEI nitrogen functions). The methoxide solution is sucked into the autoclave under vacuum and then the autoclave temperature controller setpoint is increased to 1 30° C. A device is used to monitor the power consumed by the agitator. The agitator power is monitored along with the temperature and pressure. Agitator power and temperature values gradually increase as methanol is removed from the autoclave and the viscosity of the mixture increases and stabilizes in about 1 hour indicating that most of the methanol has been removed. The mixture is further heated and agitated under vacuum for an additional 30 minutes.

Vacuum is removed and the autoclave is cooled to 105° C. while it is being charged with nitrogen to 250 psia and then vented to ambient pressure. The autoclave is charged to 200 psia with nitrogen. Ethylene oxide is again added to the autoclave incrementally as before while closely monitoring the autoclave pressure, temperature, and ethylene oxide flow rate while maintaining the temperature between 100° C. and 110° C. and limiting any temperature increases due to reaction exotherm. After the addition of 4,500 g of ethylene oxide (resulting in a total of 7 moles of ethylene oxide per mole of PEI nitrogen function) is achieved over several hours, the temperature is increased to 110° C. and the mixture stirred for an additional hour.

The reaction mixture is then collected in nitrogen purged containers and eventually transferred into a 22 L three neck round bottomed flask equipped with heating and agitation. The strong alkali catalyst is neutralized by adding 167 g methanesulfonic acid (1.74 moles).

SYNTHESIS EXAMPLE 2

4.7% Quaternization of PEI 1800 E7

To a 500 ml erlenmeyer flask equipped with a magnetic stirring bar is added poly(ethyleneimine), MW 1800 ethoxylated to a degree of 7 (224 g, 0.637 mol nitrogen, prepared as in Synthesis Example 1) and acetonitrile (Baker, 150 g, 3.65 mol). Dimethyl sulfate (Aldrich, 3.8 g, 0.030 mol) is added all at once to the rapidly stirring solution, which is then stoppered and stirred at room temperature overnight. The acetonitrile is evaporated on the rotary evaporator at ~60° C., followed by a Kugelrohr apparatus (Aldrich) at ~80° C. to afford ~220 g of the desired material as a dark brown viscous liquid. A $^{13}$C-NMR ($D_2O$) spectrum shows the absence of a peak at ~58 ppm corresponding to dimethyl sulfate. A $^{1}$H-NMR ($D_2O$) spectrum shows the partial shifting of the peak at 2.5 ppm (methylenes attached to unquaternized nitrogens) to ~3.0 ppm.

SYNTHESIS EXAMPLE 3

Oxidation of 4.7% Quaternized PEI 1800 E7

To a 500 ml erlenmeyer flask equipped with a magnetic stirring bar is added poly(ethyleneimine), MW 1800 which has been ethoxylated to a degree of 7, and ~4.7% quaternized with dimethyl sulfate (121.7 g, ~0.32 mol oxidizeable nitrogen, prepared as in Synthesis Example 2), hydrogen peroxide (Aldrich, 40 g of a 50 wt % solution in water, 0.588 mol), and water (109.4 g). The flask is stoppered, and after an initial exotherm the solution is stirred at room temperature overnight. A $^{1}$H-NMR ($D_2O$) spectrum shows the total shifting of the methylene peaks at 2.5–3.0 ppm to ~3.5 ppm. To the solution is added ~5 g of 0.5% Pd on alumina pellets, and the solution is allowed to stand at room temperature for ~3 days. Peroxide indicator paper shows that no peroxide is left in the system. The material is stored as a 46.5% solution in water.

SYNTHESIS EXAMPLE 4

Formation of Amine Oxide of PEI 1800 $E_7$

To a 500 mL Erlenmeyer flask equipped with a magnetic stirring bar is added polyethyleneimine having a molecular weight of 1800 and ethoxylated to a degree of about 7 ethoxy groups per nitrogen (PEI-1800, $E_7$) (209 g, 0.595 mol nitrogen, prepared as in Synthesis Example 1), and hydrogen peroxide (120 g of a 30 wt % solution in water, 1.06 mol). The flask is stoppered, and after an initial exotherm the solution is stirred at room temperature overnight. 1H-NMR ($D_2O$) spectrum obtained on a sample of the reaction mixture indicates complete conversion. The resonances ascribed to methylene protons adjacent to unoxidized nitrogens have shifted from the original position at ~2.5 ppm to ~3.5 ppm. To the reaction solution is added approximately 5 g of 0.5%

Pd on alumina pellets, and the solution is allowed to stand at room temperature for approximately 3 days. The solution is tested and found to be negative for peroxide by indicator paper. The material as obtained is suitably stored as a 51.1% active solution in water.

SYNTHESIS EXAMPLE 5

Preparation of PEI 1200 $E_1$

Step A)

The ethoxylation is conducted in a 2 gallon stirred stainless steel autoclave equipped for temperature measurement and control, pressure measurement, vacuum and inert gas purging, sampling, and for introduction of ethylene oxide as a liquid. A ~20 lb. net cylinder of ethylene oxide (ARC) is set up to deliver ethylene oxide as a liquid by a pump to the autoclave with the cylinder placed on a scale so that the weight change of the cylinder could be monitored.

A 750 g portion of polyethyleneimine (PEI) (having a listed average molecular weight of 1200 equating to about 0.625 moles of polymer and 17.4 moles of nitrogen functions) is added to the autoclave. The autoclave is then sealed and purged of air (by applying vacuum to minus 28" Hg followed by pressurization with nitrogen to 250 psia, then venting to atmospheric pressure). The autoclave contents are heated to 130° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned off and cooling is applied to limit any temperature increase resulting from any reaction exotherm. The temperature is maintained between 100° C. and 110° C. while the total pressure is allowed to gradually increase during the course of the reaction. After a total of 750 grams of ethylene oxide has been charged to the autoclave (roughly equivalent to one mole ethylene oxide per PEI nitrogen function), the temperature is increased to 110° C. and the autoclave is allowed to stir for an additional hour. At this point, vacuum is applied to remove any residual unreacted ethylene oxide.

Step B)

The reaction mixture is then deodorized by passing about 100 cu. ft. of inert gas (argon or nitrogen) through a gas dispersion frit and through the reaction mixture while agitating and heating the mixture to 130° C.

The final reaction product is cooled slightly and collected in glass containers purged with nitrogen.

In other preparations the neutralization and deodorization is accomplished in the reactor before discharging the product.

If a PEI 1200 $E_7$ is desired, the following step of catalyst addition will be included between Step A and B.

Vacuum is continuously applied while the autoclave is cooled to about 50° C. while introducing 376 g of a 25% sodium methoxide in methanol solution (1.74 moles, to achieve a 10% catalyst loading based upon PEI nitrogen functions).

The methoxide solution is sucked into the autoclave under vacuum and then the autoclave temperature controller setpoint is increased to 130° C. A device is used to monitor the power consumed by the agitator. The agitator power is monitored along with the temperature and pressure. Agitator power and temperature values gradually increase as methanol is removed from the autoclave and the viscosity of the mixture increases and stabilizes in about 1 hour indicating that most of the methanol has been removed. The mixture is further heated and agitated under vacuum for an additional 30 minutes.

Vacuum is removed and the autoclave is cooled to 105° C. while it is being charged with nitrogen to 250 psia and then vented to ambient pressure. The autoclave is charged to 200 psia with nitrogen. Ethylene oxide is again added to the autoclave incrementally as before while closely monitoring the autoclave pressure, temperature, and ethylene oxide flow rate while maintaining the temperature between 100° C. and 110° C. and limiting any temperature increases due to reaction exotherm. After the addition of 4,500 g of ethylene oxide (resulting in a total of 7 moles of ethylene oxide per mole of PEI nitrogen function) is achieved over several hours, the temperature is increased to 110° C. and the mixture stirred for an additional hour.

The reaction mixture is then collected in nitrogen purged containers and eventually transferred into a 22 L three neck round bottomed flask equipped with heating and agitation. The strong alkali catalyst is neutralized by adding 167 g methanesulfonic acid (1.74 moles).

Other preferred examples such as PEI 1200 E15 and PEI 1200 E20 can be prepared by the above method by adjusting the reaction time and the relative amount of ethylene oxide used in the reaction.

SYNTHESIS EXAMPLE 6

9.7% Quaternization of PEI 1200 E7

To a 500 ml erlenmeyer flask equipped with a magnetic stirring bar is added poly(ethyleneimine), MW 1200 ethoxylated to a degree of 7 (248.4 g, 0.707 mol nitrogen, prepared as in Synthesis Example 5) and acetonitrile (Baker, 200 mL). Dimethyl sulfate (Aldrich, 8.48 g, 0.067 mol) is added all at once to the rapidly stirring solution, which is then stoppered and stirred at room temperature overnight. The acetonitrile is evaporated on the rotary evaporator at ~60° C., followed by a Kugelrohr apparatus (Aldrich) at ~80° C. to afford ~220 g of the desired material as a dark brown viscous liquid. A $^{13}$C-NMR ($D_2O$) spectrum shows the absence of a peak at ~58 ppm corresponding to dimethyl sulfate. A $^{1}$H-NMR ($D_2O$) spectrum shows the partial shifting of the peak at 2.5 ppm (methylenes attached to unquaternized nitrogens) to ~3.0 ppm.

SYNTHESIS EXAMPLE 7

4.7% Oxidation of 9.5% Quaternized PEI 1200 E7

To a 500 ml erlenmeyer flask equipped with a magnetic stirring bar is added poly(ethyleneimine), MW 1200 which has been ethoxylated to a degree of 7, and ~9.5% quaternized with dimethyl sulfate (144 g, ~0.37 mol oxidizeable nitrogen, prepared as in Example 6), hydrogen peroxide (Aldrich, 35.4 g of a 50 wt % solution in water, 0.52 mol), and water (100 g). The flask is stoppered, and after an initial exotherm the solution is stirred at room temperature overnight. A 1H-NMR ($D_2O$) spectrum shows the total shifting of the methylene peaks at 2.5–3.0 ppm to ~3.5 ppm. To the solution is added just enough sodium bisulfite as a 40% water solution to bring the residual peroxide level down to 1–5 ppm. The sodium sulfate which forms causes an aqueous phase to separate which contains salts, but little or no organics. The aqueous salt phase is removed and the desired oxidized polyethyleneimine derivative is obtained and stored as a 52% solution in water.

EXAMPLE 1

The following compositions are in accordance with the present invention

| Component | A | B | C | D | E | F | G |
|---|---|---|---|---|---|---|---|
| DEQA | 2.6 | 2.9 | 18.0 | 19.0 | 19.0 | — | — |
| TAE25 | | — | 1.0 | — | — | — | — |
| Fatty acid | 0.3 | — | 1.0 | — | — | — | — |
| Hydrochloride acid | 0.02 | 0.02 | 0.02 | 0.02 | 0.02 | — | — |
| PEG | — | — | 0.6 | 0.6 | 0.6 | — | — |
| Perfume | 1.0 | 1.0 | 1.0 | 1.0 | 1.0 | — | — |
| Silicone antifoam | 0.01 | 0.01 | 0.01 | 0.01 | 0.01 | — | — |
| PEG | 3 | 3 | 3 | 3 | 3 | 15 | 10 |
| Dye fix 1 | 1 | 1 | 1 | 1 | 1 | 5 | 10 |
| Dye fix 2 | 2 | 2 | 2 | 2 | — | — | — |
| Electrolyte (ppm) | — | — | 600 | 600 | 1200 | — | — |
| Dye (ppm) | 10 | 10 | 50 | 50 | 50 | — | — |
| Water and minors to balance to 100 | | | | | | | |

| Component | H | I | J | K | L | M | N | O | P |
|---|---|---|---|---|---|---|---|---|---|
| DTDMAC | — | — | — | — | — | — | — | 4.5 | 15 |
| DEQA | 2.6 | 2.9 | 18.0 | 19.0 | 19.0 | — | — | — | — |
| TAE25 | 0.3 | — | 1.0 | — | 0.1 | — | — | — | — |
| Fatty acid | 0.3 | — | 1.0 | — | — | — | — | — | — |
| Hydrochloride acid | 0.02 | 0.02 | 0.02 | 0.02 | 0.02 | — | — | 0.02 | 0.02 |
| PEG | — | — | 0.6 | 0.6 | 0.6 | — | — | — | 0.6 |
| Perfume | 1.0 | 1.0 | 1.0 | 1.0 | 1.0 | — | — | 1.0 | 1.0 |
| Silicone antifoam | 0.01 | 0.01 | 0.01 | 0.01 | 0.01 | — | — | 0.01 | 0.01 |
| PEI 1800 E1 | 3 | — | — | 3 | — | 10 | — | — | 3 |
| PEI 1200 E1 | — | 3 | 3 | — | 3 | — | 15 | 3 | — |
| Dye fix 1 | 1 | 1 | 1 | 1 | 3 | 10 | 5 | 1 | 1 |
| Dye fix 2 | 2 | 2 | 2 | 2 | — | — | — | 2 | 2 |
| Electrolyte (ppm) | — | — | 600 | 600 | 1200 | — | — | — | 600 |
| Dye (ppm) | 10 | 10 | 50 | 50 | 50 | — | — | 10 | 50 |
| Carezyme CEVU/g of composition | — | — | — | — | 50 | — | — | — | — |
| Water and minors to balance to 100 | | | | | | | | | |

EXAMPLE 2

The following compositions for use as dryer-added sheets are in accordance with the invention

| | Q | R | S | T | U | V |
|---|---|---|---|---|---|---|
| DOEQA | 39.16 | 24.79 | — | — | — | — |
| DHEQA | — | — | 21.81 | — | — | — |
| DTDMAMS | — | — | — | 18.64 | 11.94 | 62.0 |
| SDASA | 34.41 | 28.16 | 21.33 | 28.04 | 21.52 | — |
| Glycosperse S-20 | — | — | 12.38 | — | — | — |
| Glycerol Monostearate | — | — | — | 18.87 | 13.23 | — |
| Clay | 4.02 | 4.02 | 3.16 | 3.91 | 3.90 | — |
| Perfume | 0.7 | 1.1 | 0.7 | 1.6 | 2.6 | 1.4 |
| PEI | — | 5.3 | — | — | — | — |
| PEI 1200 E1 | — | — | 4.1 | 2.2 | — | — |
| PEI 1800 E1 | 2.1 | — | — | — | 5.2 | 7.0 |
| Dye fix 1 | 2.1 | 5.3 | 4.1 | 2.2 | 5.2 | 3.2 |
| Stearic acid to balance | | | | | | |

What is claimed is:

1. A laundry detergent composition comprising:

a) from about 0.001% to about 10% by weight, of a dye fixing agent;

b) from about 0.01% to about 50% by weight, a water-soluble or dispersible, modified polyamine, said modified polyamine comprising a polyamine backbone prior to modification via quaternization, substitution, or oxidation corresponding to the formula:

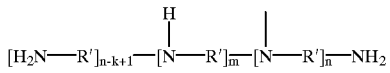

having a modified polyamine formula $V_{(n+1)}W_mY_nZ$ or a polyamine backbone prior to modification via quaternization, substitution, or oxidation corresponding to the formula:

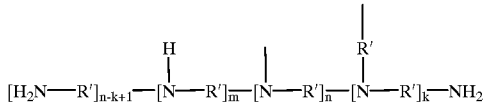

having a modified polyamine formula $V_{(n-k+1)}W_mY_nY'_kZ$, wherein k is less than or equal to n, said polyamine backbone prior to has a molecular weight greater than about 200 daltons, wherein i) V units are terminal units having the formula:

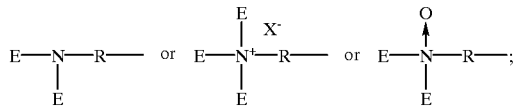

ii) W units are backbone units having the formula:

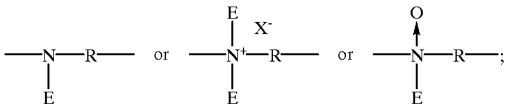

iii) Y units are branching units having the formula:

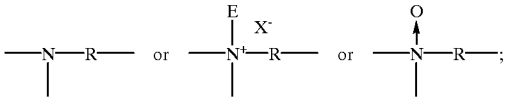

iv) Z units are terminal units having the formula:

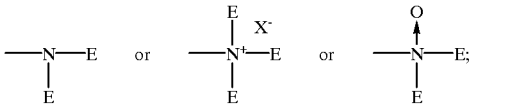

wherein backbone linking R units are $C_2$–$C_{12}$ alkylene; $R^1$ is $C_2$–$C_6$ alkylene, and mixtures thereof; E units are selected from the group consisting of hydrogen, $C_1$–$C_{22}$ alkyl, —$(CH_2)_pCO_2M$, —$(CH_2)_qSO_3M$, —$CH(CH_2CO_2M)CO_2M$, —$(CH_2)_pPO_3M$, —$(R^1O)_xB$, and mixtures thereof; provided that at least one E unit is—$CH(CH_2CO_2M)CO_2M$, or —$(CH_2)_pPO_3M$; provided that when any E unit of a nitrogen is a hydrogen, said nitrogen is not also an N-oxide; B is hydrogen, $C_1$–$C_6$ alkyl, —$(CH_2)_qSO_3M$, —$(CH_2)_pCO_2M$, —$(CH_2)_q(CHSO_3M)CH_2SO_3M$, —$(CH_2)_q$— $(CHSO_2M)CH_2SO_3M$, —$(CH_2)_pPO_3M$, —$PO_3M$, and mixtures thereof, provided when B is an ionizable unit selected from the group consisting of —$(CH_2)_qSO_3M$, —$(CH_2)_pCO_2M$, —$(CH_2)_q(CHSO_3M)$—$CH_2SO_3M$, —$(CH_2)_q(CHSO_2M)CH_2SO_3M$, —$(CH_2)_pPO_3M$, —$PO_3M$, and mixtures thereof, at least one backbone nitrogen is quaternized; M is hydrogen or a water soluble cation in sufficient amount to satisfy charge balance; X is a water soluble anion; m has the value from 4 to about 400; n has the value from 0 to about 200; p has the value from 1 to 6, q has the value from 0 to 6; x has the value from 11 to 100; and c) the balance carrier and adjunct ingredients.

2. A composition according to claim 1 wherein R is $C_2$–$C_4$ alkylene, and mixtures thereof.

3. A composition according to claim 2 wherein R is ethylene.

4. A composition according to claim 1 wherein $R^1$ is at least 50% ethylene.

5. A composition according to claim 4 wherein $R^1$ is ethylene.

6. A composition according to claim 1 wherein E units are hydrogen, —$(R^1O)_xB$, —$(CH_2)_pCO_2M$, —(CH2)$_qSO_3M$, —$CH(CH_2CO_2M)CO_2M$, and mixtures thereof.

7. A composition according to claim 6 wherein E units are hydrogen, —$(R^1O)_xB$, and mixtures thereof.

8. A composition according to claim 7 wherein E units are —$(R^1O)_xB$.

9. A composition according to claim 6 wherein B units are hydrogen, —$(CH_2)_qSO_3M$, —$(CH_2)_q(CHSO_3M)CH_2SO_3M$, —$(CH_2)_q(CHSO_2M)$—$CH_2SO_3M$, and mixtures thereof, wherein q has the value from 0 to 3.

10. A composition according to claim 9 wherein B is hydrogen, —$(CH_2)_qSO_3M$, and mixtures thereof, wherein q has the value from 0 to 3.

11. A composition according to claim 1 further comprising from 1% to 99% by weight, of a cationic fabric softener selected from:

i)

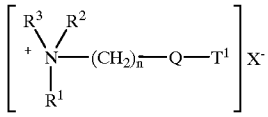

ii)

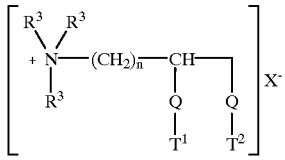

iii) and mixtures thereof;

wherein Q is —O—C(O)—, —C(O)—O—, —O—C(O)—O—, —$NR^4$—C(O)—, —C(O)—$NR^4$—, and mixtures thereof; $R^1$ is $(CH_2)_n$—Q—$T^2$, $T^3$ and mixtures thereof; $R^2$ is $(CH_2)_m$—Q—$T^4$, $T^5$, $R^3$, and mixtures thereof; $R^3$ is $C_1$–$C_4$ alkyl, $C_1$–$C_4$ hydroxyalkyl, H, and mixtures thereof; $R^4$ is H, $C_1$–$C_1$–$C_4$ alkyl, $C_1$–$C_4$ hydroxyalkyl, and mixtures thereof; $T^1$, $T^2$, $T^3$, $T^4$, $T^5$ are each independently $C_{11}$–$C_{22}$ alkyl, alkenyl, and mixtures thereof; n and m are integers from 1 to 4; and $X^-$ is a softener-compatible anion.

12. A laundry detergent composition comprising:

a) from about 0.001% to about 10% by weight, of a dye fixing agent;

b) from 1% to 99% by weight, of a cationic fabric softener selected from:

i)

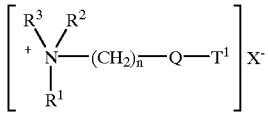

ii)

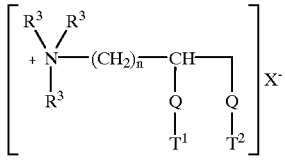

iii) and mixtures thereof;

wherein Q is —O—C(O)—, —C(O)—O—, —O—C(O)—O—, —$NR^4$—C(O)—, —C(O)—$NR^4$—, and mixtures thereof; $R^1$ is $(CH_2)_n$—Q—$T^2$, $T^3$ and mixtures thereof; $R^2$ is $(CH_2)_m$—Q—$T^4$, $T^5$, $R^3$, and mixtures thereof; $R^3$ is $C_1$–$C_4$ alkyl, $C_1$–$C_4$ hydroxyalkyl, H, and mixtures thereof , $R^4$ is H, $C_1$–$C_4$ alkyl, $C_1$–$C_4$ hydroxyalkyl, and mixtures thereof; $T^1$, $T^2$, $T^3$, $T^4$, $T^5$ are each independently $C_1$–$C_{22}$ alkyl, alkenyl, and mixtures thereof; n and m are integers from 1 to 4; and $X^-$ is a softener-compatible anion c) from about 0.01% to about 50% by weight, a water-soluble or dispersible, modified polyamine, said modified polyamine comprising a polyamine backbone prior to modification via quaternization, substitution, or oxidation corresponding to the formula:

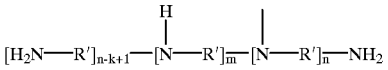

having a modified polyamine formula $V_{(n+1)}W_mY_nZ$ or a polyamine backbone prior to modification via quaternization, substitution, or oxidation corresponding to the formula:

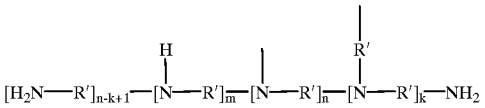

having a modified polyamine formula $V_{(n-k+1)}W_mY_nY'_kZ$, wherein k is less than or equal to n, said polyamine backbone prior to has a molecular weight greater than about 200 daltons, wherein i) V units are terminal units having the formula:

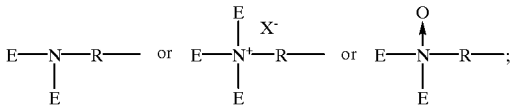

ii) W units are backbone units having the formula:

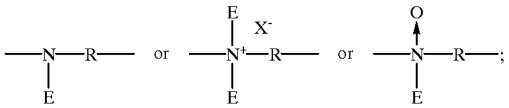

iii) Y units are branching units having the formula:

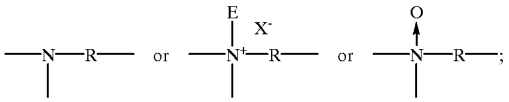

iv) Z units are terminal units having the formula:

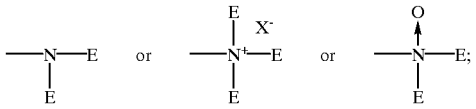

wherein backbone linking R units are ethylene; $R^1$ is ethylene, and mixtures thereof; E units are selected from the group consisting of hydrogen, $—(CH_2)_pCO_2M$, $—(CH_2)_qSO_3M$, $—CH(CH_2CO_2M)CO_2M$, $—(CH_2)_pPO_3M$, $—(R^1O)_xB$, and mixtures thereof; provided that at least one E unit is $—CH(CH_2CO_2M)CO_2M$, or $—(CH_2)_pPO_3M$; provided that when any E unit of a nitrogen is a hydrogen, said nitrogen is not also an N-oxide; B is $—(CH_2)_qSO_3M$, $—(CH_2)_pCO_2M$, $—(CH_2)_q(CHSO_3M)—CH_2SO_3M$, $—(CH_2)_q—(CHSO_2M)CH_2SO_3M$, $—(CH_2)_pPO_3M$, $—PO_3M$, and mixtures thereof, provided when B is an ionizable unit selected from the group consisting of $—(CH_2)_qSO_3M$, $—(CH_2)_pCO_2M$, $—(CH_2)_q(CHSO_3M)—CH_2SO_3M$, $—(CH_2)_q(CHSO_2M)CH_2SO_3M$, $—(CH_2)_pPO_3M$, $—PO_3M$, and mixtures thereof, at least one backbone nitrogen is quaternized; at least one backbone nitrogen is a quaternized nitrogen unit selected from the group consisting of:

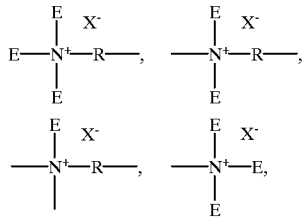

and mixtures thereof; and the ratio of quaternized nitrogens to ionizable B units is at least 1:1; M is hydrogen or a water soluble cation in sufficient amount to satisfy charge balance; X is a water soluble anion; m has the value from 4 to about 400; n has the value from 0 to about 200; p has the value from 1 to 6, q has the value from 0 to 6; x has the value from 11 to 100; and c) the balance carrier and adjunct ingredients.

13. A composition according to claim 12 wherein said dye fixing agent is selected from the group consisting of oleyl aminoethylamide, oleyl methyl diethylenediamine methosulphate, monostearyl ethylene di amino trimethyl ammonium methosulphate, and mixtures thereof.

* * * * *